US005520234A

United States Patent [19]

Simmons

[11] Patent Number: 5,520,234

[45] Date of Patent: May 28, 1996

[54] WINDOW TOP DECORATING ASSEMBLY

[76] Inventor: David O. Simmons, 16609 Black Kettle Dr., Leander, Tex. 78641

[21] Appl. No.: 164,324

[22] Filed: Dec. 8, 1993

[51] Int. Cl.[6] ..... E06B 9/00

[52] U.S. Cl. ..... 160/38; 160/19

[58] Field of Search ..... 160/38, 39, 19, 160/902, 330; 248/251, 266; 211/105.2, 105.1

[56] References Cited

U.S. PATENT DOCUMENTS

| | | | |
|---|---|---|---|
| 2,513,628 | 7/1950 | Eaglin | 160/39 |
| 3,007,036 | 10/1961 | Mills, Jr. | 160/38 X |
| 3,996,987 | 12/1976 | Rodriguez | 160/19 |
| 4,246,951 | 1/1981 | Givens | 160/39 |
| 4,644,991 | 2/1987 | Boyd | 160/38 |
| 4,662,421 | 5/1987 | Basmadji | 160/38 |
| 4,828,002 | 5/1989 | Ashby | 160/38 |
| 4,903,394 | 2/1990 | Roberts | 29/458 |
| 5,014,951 | 5/1991 | Bonk | 160/38 X |
| 5,042,548 | 8/1991 | Attal | 160/38 |
| 5,042,549 | 8/1991 | Roberts | 160/39 |
| 5,062,463 | 11/1991 | Peters | 160/38 |
| 5,152,331 | 10/1992 | Barone | 160/38 |
| 5,159,965 | 11/1992 | Roy | 160/38 |
| 5,217,784 | 6/1993 | Shepherd | 428/99 |

FOREIGN PATENT DOCUMENTS

| | | | |
|---|---|---|---|
| 532342 | 8/1931 | Germany | 160/38 |

*Primary Examiner*—Blair M. Johnson

[57] ABSTRACT

An assembly for decorating the top of a window. Generally, the assembly includes a pair of linear members with side panels attached at each end. The side panels have integral mounting posts being received by slots in the linear members. Optionally, the linear members are attached to the side panels with discrete couplings that are received by both the side panels and the linear members. A fabric covering is applied over the assembly and attached to the rear of the assembly by use of glue. Optionally, the fabric covering is attached via a mechanical fastening system located on the rear of the assembly. Mounting brackets are used to secure the window top decorating assembly directly to the wall surrounding the window or, if a window covering unit is in place, to the headrail of the window covering unit.

24 Claims, 6 Drawing Sheets

Figure 6
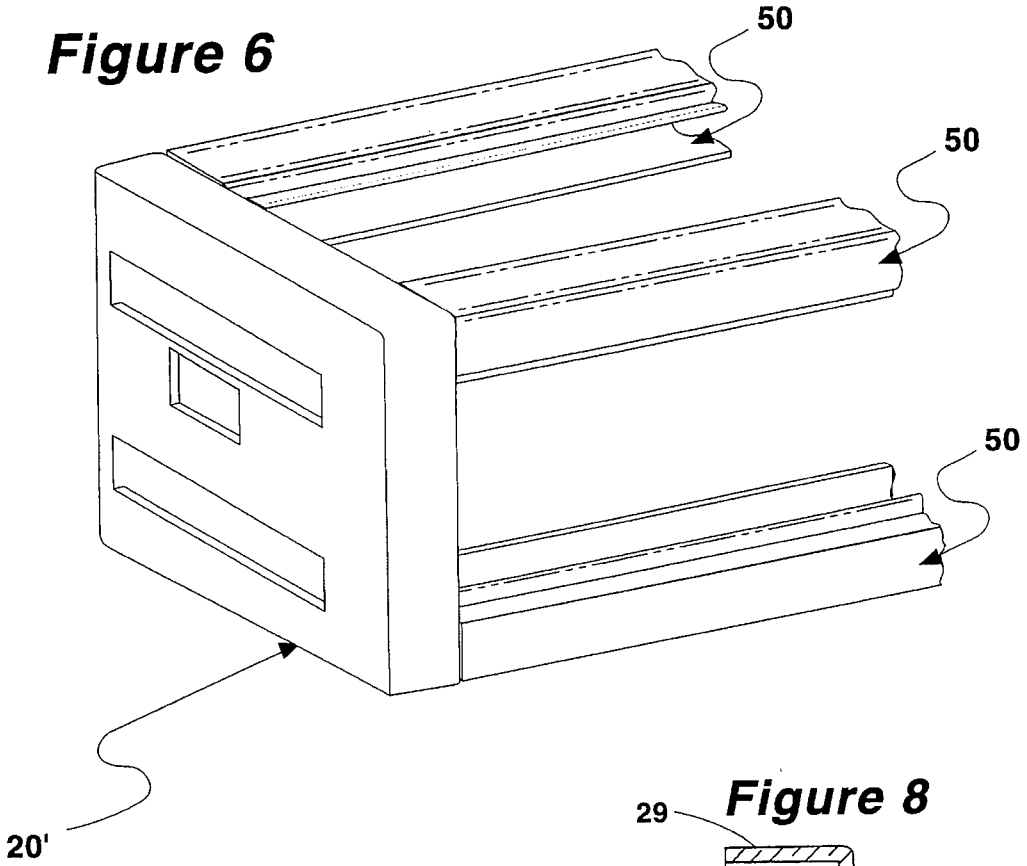
Figure 8
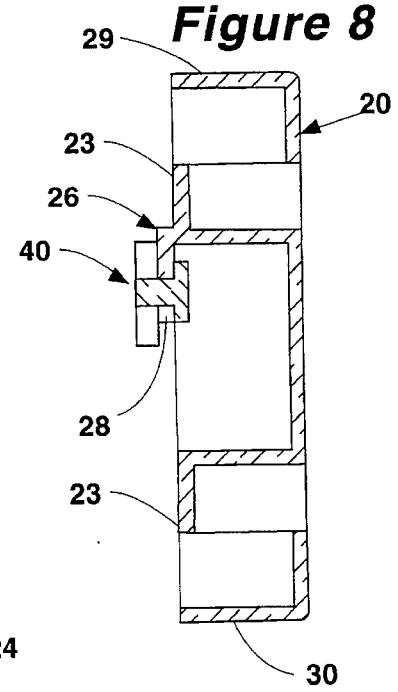
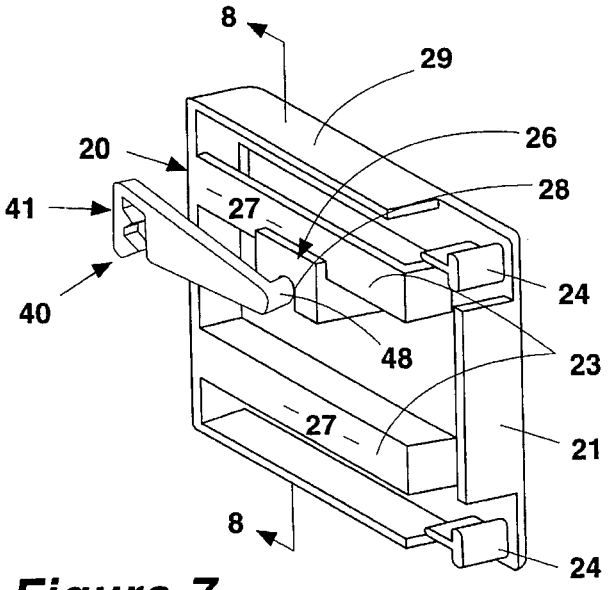
Figure 7

Figure 9A
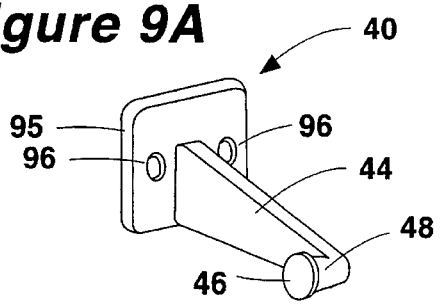
Figure 9B
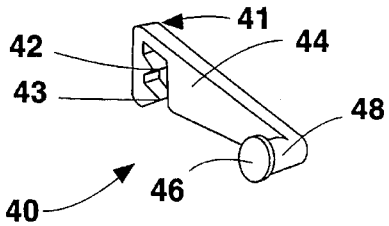
Figure 9C
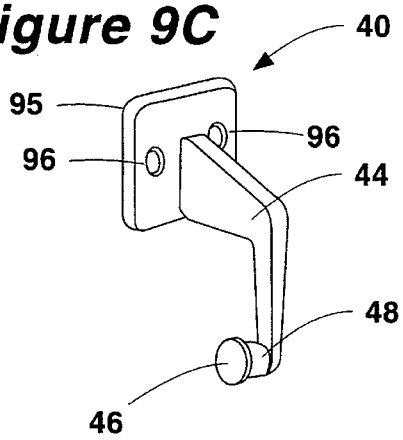
Figure 9D
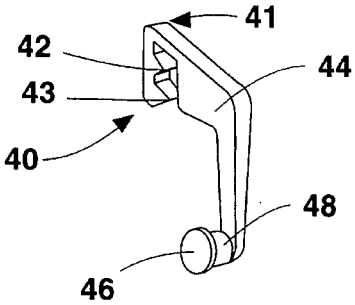
Figure 9E
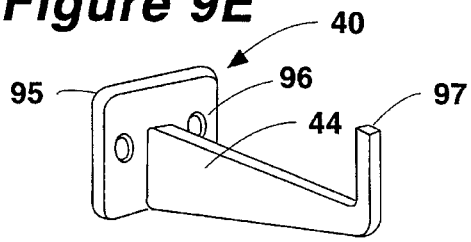
Figure 9F
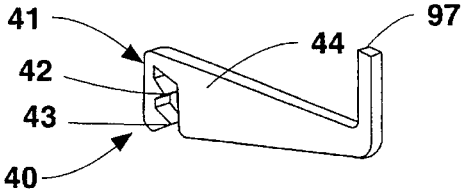
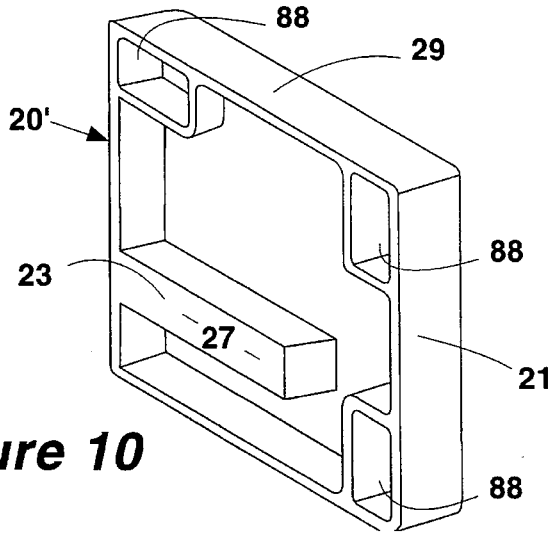
Figure 10

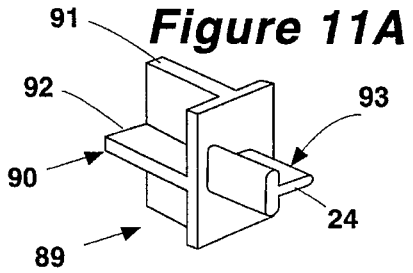
Figure 11A
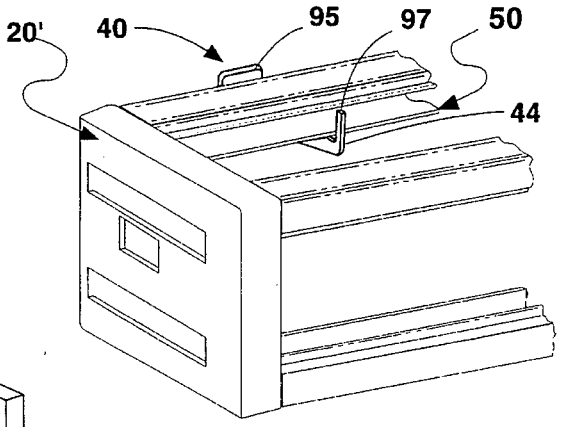
Figure 12
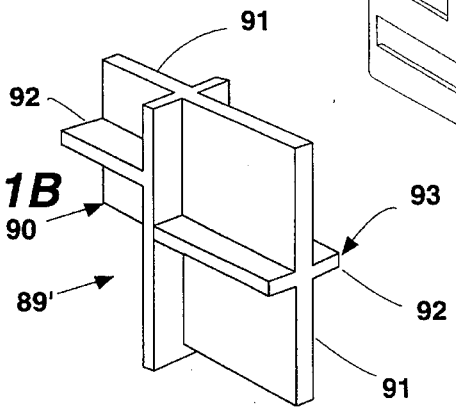
Figure 11B
Figure 13A
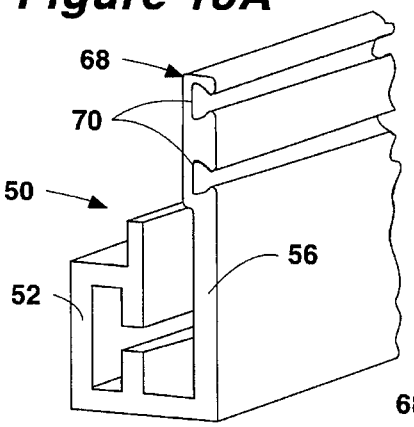
Figure 13B
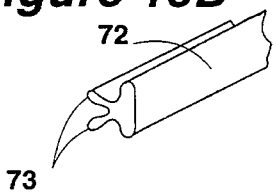
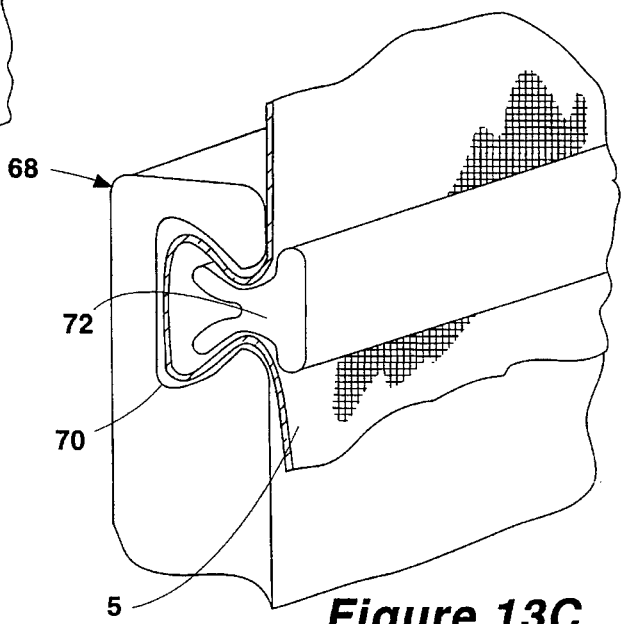
Figure 13C
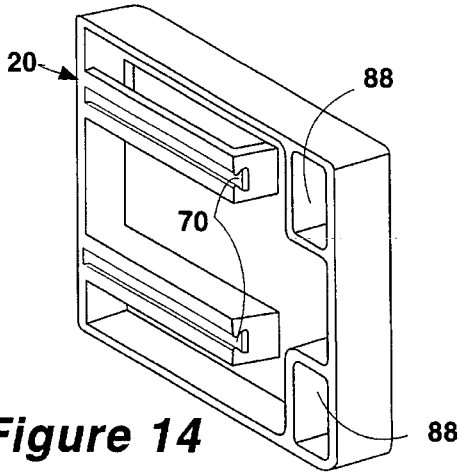
Figure 14

Figure 15A
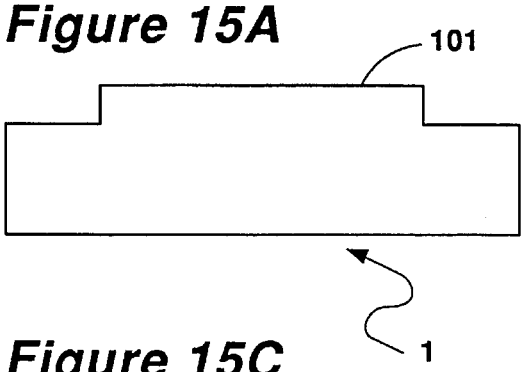
Figure 15B
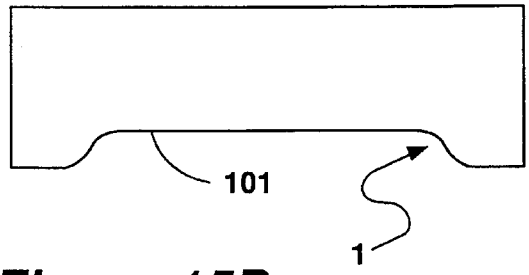
Figure 15C
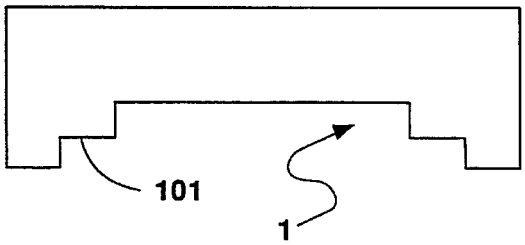
Figure 15D
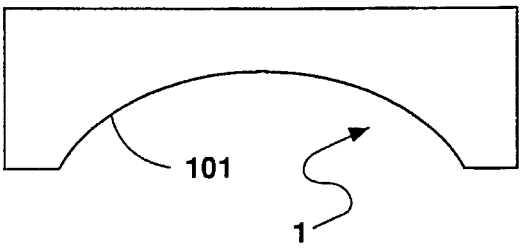
Figure 16A
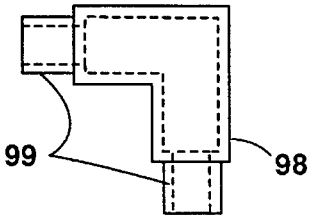
Figure 16B
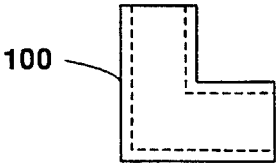
Figure 16C
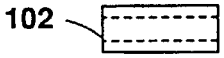
Figure 16F
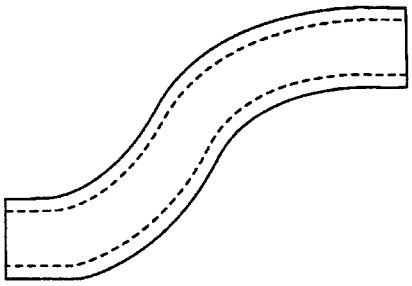
Figure 16D
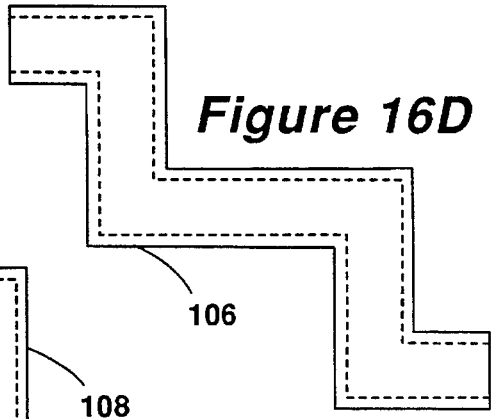
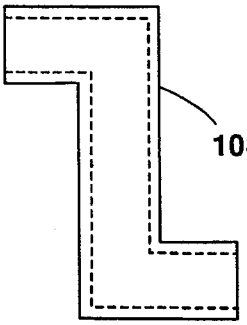
Figure 16E
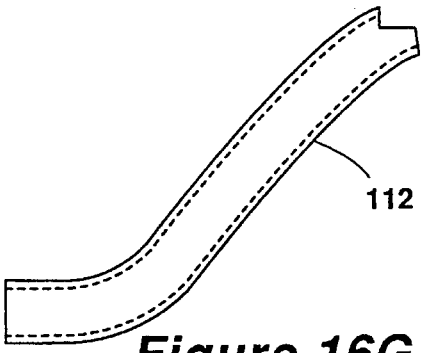
Figure 16G

WINDOW TOP DECORATING ASSEMBLY

BACKGROUND OF THE INVENTION

1. Field of the Invention

This invention relates generally to window coverings, and more particularly, to fabric covered and fabric accented assemblies for enclosing and ornamenting the headrail of a window covering, for decorating interior window tops, or for accomplishing both of these objectives.

2. Description of the Prior Art

Several types of hanging window covering units have been proposed, and generally, these window covering units hang from a headrail constructed from metal or plastic. As these headrails are designed for structural adequacy, they are not usually aesthetically pleasing. Therefore, to provide an aesthetically pleasing appearance, it has become common practice to use a window top decorating assembly commonly known as a "cornice" or "valence" to conceal the headrail, and often times, to decorate the entire top of the window. Furthermore, in many cases, the aesthetic appeal of these decorating assemblies is improved by covering or accenting them with fabric or other thin material.

For example, U.S. Pat. No. 4,644,991 to Boyd discloses a cornice assembly having a spring loaded, interchangeable tapestry cover for improving the aesthetic appeal of the frontal surfaces. U.S. Pat. No. 4,664,421 to Basmadji et al, U.S. Pat. No. 4,828,002 to Ashby, and U.S. Pat. No. 5,042,548 to Attal each disclose a cornice-type assembly consisting of a series of panels in which strips of colored fabric, plastic, or metal can be inserted to provide improved aesthetic appeal. Specifically, Basmadji and Attal disclose assemblies consisting of front and side panels having grooves along their upper and lower edges which accept and retain strips of thin material such as wall paper or fabric. Ashby teaches an assembly similar to that of Basmadji and Attal except that the side panels taught by Ashby are not equipped for accepting or retaining any type of decorating strips. U.S. Pat. No. 5,042,549 to Roberts discloses a fabric covered cornice-type assembly constructed from rigid plastic foam.

Although the decorating assemblies of each of these patents address the problem of concealing the headrail of a window covering unit or decorating the top of a window, each are subject to one or more of the following deficiencies: 1.) The physical structure limits the level of aesthetic value provided, 2.) The structure does not readily lend itself to being covered with a fabric: or other thin material, 3.) The structure does not readily lend itself to providing unique shapes and diverse sizes.

Specifically, the decorating assembly taught by Boyd does not have a structure that would allow it to be covered with fabric. As taught, this assembly is only suited to have its front surfaces covered with fabric. As a result, the edges and therefore portions of the backside, would be exposed. Furthermore, its physical structure significantly limits the shape of the portion of the assembly to be covered to rectangular. The decorating assemblies taught by Basmadji, Ashby, and Attal each have physical limitations that make them unsuitable for covering with a fabric. The first of these limitations is the front surfaces not being flat. This condition would cause unacceptable discontinuities in a fabric covering. Secondly, as taught, the structures of the assemblies do not readily lend themselves to providing any shape other than rectangular. Furthermore, the depth (i.e. overall thickness) of the front and side panels is far too thin to be considered a suitable or desired structure for covering with a fabric.

SUMMARY OF THE INVENTION

The present invention is directed to provide a window top decorating assembly that overcomes or substantially reduces the noted deficiencies of the prior art by providing a structure which readily lends itself to: 1.) being covered with a fabric material or the like and 2.) being constructed in a variety of sizes and shapes.

According to a preferred embodiment of the invention, a window top decorating assembly for covering with a fabric material or the like is provided. The decorating assembly generally includes a structural assembly having two side panels and two linear members having preferably flat front walls and at least one offset rear wall. The offset rear walls establish a channel running in the longitudinal direction that provides the linear members and the side panels with the desired overall depth and provides a location where the fabric covering can be affixed. In the most simplistic case, the structural configuration of the linear members is represented by a rectangular tube or a U-shape channel. Preferably, the overall depth of the side panels and the linear members is the same. This depth is typically one-quarter of an inch or greater. Furthermore, it is also preferable that the rear walls of the linear members and the side panels be configured such that when the fabric is affixed, the portions of the backside of the assembly which can be viewed from the front are concealed by the fabric. In the preferred case, the linear members and side panels are joined to each other by mounting posts integral to the side panels that engage into the linear members. These mounting posts are generally located at the top and bottom of the side panels such that one linear members is flush with the top surface of the side panel and the other linear member is flush with the bottom surface of the side panel. As described, such a structural configuration produces an assembly without a top surface. Optionally, a mounting post can be located at the top rear position of the side panels and a third linear member can be employed to provide an assembly with a front, sides, and top. Also, the side panels can optionally be equipped with cavities for receiving unions rather than being equipped with mounting posts, and the linear members can be joined with the side panel using discrete unions. In all embodiments, it is preferable that the front surfaces of the linear members and the side panels be smooth.

The fabric covering is preferably affixed to the assembly using either an adhesive method or a mechanical fastening system. The adhesive method generally consists of using glue to affix the fabric to the rear surface of the linear members and side panels. In one configuration, the mechanical fastening system generally consists of a series of slots or ribs on the rear of the linear members and the side panels and a set of fabric fastening strips. The fabric is retained by positioning it over the slot or rib and then engaging a fastening strip along the length of the slot or rib. Optionally, the fabric fastening strip can be replaced by discrete fabric fastening clips. Unlike the adhesive method, the mechanical fastening system has the advantage of enabling the fabric to be readily released once attached.

Preferred embodiment of the invention, only one of the two linear members in the frontal positions of the first embodiment has a rear wall. The linear member without the rear wall generally does not provide a preferred location for affixing the fabric, and is generally positioned in the lower mounting position. Preferably, this linear member has a cross-section enabling it to be affixed to the side panels via the same method used for mounting the other linear members.

In a first alternate configuration of the above mentioned embodiments, a stepped or arched contour is added to the upper or lower portion of the front surface of the assembly by use of contoured unions used in combination with linear members or by use of a contoured traverse member. Generally, a decoration assembly can have contours including single and multiple arches or single and multiple steps. In the case of the stepped contours, the corners of the steps are generally either rounded or square.

In a second alternate configuration of the above mentioned embodiments, at least one of the side panels is replaced with an end cap. The end cap enables an assembly to be constructed without the fabric covering on one or both ends. This configuration is desired in applications where the assembly is being installed with one or both ends against a wall or other similar structure.

Furthermore, in all of the above embodiments and alternate configurations, the ensuing structure results in an assembly having a front surface with an opening. Optionally, the linear members and side panels can be configured to establish a recess in the front surfaces to receive an insert panel such that the opening is eliminated. Where batting or foam is used under the fabric covering, this insert panel provides a uniform underlying surface.

Still furthermore, in all of the above embodiments and alternate configurations, the linear members can be configured to accept a support member which spans between the linear members to provide structural stability. These support members are especially desirable in applications where the length of the linear members induces bowing.

According to a third embodiment of the invention, the two linear members of the assembly of the first embodiment are replaced by a panel member. The panel member is of sufficient height such that its upper longitudinal edge is flush with the top surface of the side panel and its lower longitudinal edge is flush with the bottom surface of the side panel. The relevant alternate configurations mentioned above also apply to this embodiment.

A fourth embodiment of the invention entails use of a panel member to establish the front of the structural assembly and linear members to establish the sides of the structural assembly. In a fifth embodiment, linear members are used in combination with a set of unions to form both the front and sides of the structural assembly.

Mounting of the decorating assembly is generally accomplished using preferably two or more wall mount or headrail mounting brackets. In the case of wall mount brackets, the brackets are fastened to the wall using mechanical fasteners such as screws, and the decorating assembly attaches to the brackets. In the preferred case, the brackets are attached to the side panels. Optionally, the brackets can be attached to the upper front linear member or to the upper rear linear member, if one is present. In the case of headrail mounting brackets, the brackets preferably clip onto the headrail and the decorating assembly attaches to the brackets. To ensure mounting under diverse conditions, the bracket can be configured to accommodate a variety of headrail designs and headrail-to-assembly distances.

Other objects and advantages of the invention will become apparent to those skilled in the art from the detailed description of the invention below and the accompanying drawings.

BRIEF DESCRIPTION OF THE DRAWINGS

FIG. 6 is a perspective, fragmentary view showing a structural assembly including an upper rear linear member.

FIG. 7 is a perspective view showing the configuration of the side panel of FIGS. 1 and 2.

FIG. 8 is a sectional view of the portion indicated by line 8—8 in FIG. 7.

FIGS. 9A thru 9F are perspective views showing a variety of mounting bracket configurations.

FIG. 10 is a perspective view showing a side panel intended for use with upper and lower front linear members and an upper rear linear member.

FIGS. 11A and 11B are perspective views of discrete unions.

FIG. 12 is a perspective, fragmentary view showing the assembled relation of a mounting bracket intended for structural assemblies with a linear member in the upper rear position.

FIGS. 13A, 13B, and 13C are perspective, fragmentary views showing mechanical fabric fastening elements.

FIG. 14 is a perspective view of a side panel similar to that of FIG. 7 except having cavities instead of mounting posts and having grooves for fabric fastening.

FIGS. 15A thru 15D are front elevation views showing a variety of frontal profiles for the decorating assembly of this invention.

FIGS. 16A thru 16G are front elevation views showing a variety of structural elements for providing the frontal profiles of the decorating assemblies in FIGS. 15A thru 15D.

REFERENCE NUMERALS IN DRAWINGS

1 Decorating Assembly
2 Window Covering Unit
3 Fabric
4 Headrail
5 Foam Material
6 Structural Assembly
8 Front Wall
15 Lip
20 Side Panel
21 Front Edge
22 Front Wall
23 Rear Wall
24 Mounting Post
25 Front Surface
26 Receptacle
27 Rear Surface
28 Slot
29 Top Edge
30 Bottom Edge
40 Mounting Bracket
41 Clip Portion
42 Upper Ridge
43 Lower Ridge

44 Extension Arm
46 Shoulder
48 Shaft
50 Linear Member
51 Panel Member
52 Front Wall
54 Transverse Wall
55 Flange
56 Rear Wall
57 Front Surface
58 Rear Surface
60 Slot
61 Channel
62 Longitudinal Projection
64 Recessed Portion
66 Support Member Slot
68 Fabric Fastening Flange
70 Groove
72 Retaining Strip
73 Legs
81 Support Member
82 Notch
83 Insert Panel
88 Cavity
89 Union
90 Side Panel Engaging Portion
91 Vertical Wing
92 Horizontal Wing
93 Linear Member Engaging Portion
94 End Cap
95 Flange
96 Hole
97 Retaining Arm
98 Right Angle Coupling
99 Nipples
100 Right Angle Union
101 Frontal Edge
102 Linear Coupling
106 Double Step Union
108 Single Step Union
110 S-Curve Union
112 Contoured Structural Member

DESCRIPTION OF THE PREFERRED EMBODIMENTS

For the preferred embodiments of the invention shown in the accompanying figures and described herein, it will be understood that the present invention relates specifically to the physical configuration of the invention and generally to the configuration of the related window covering unit.

Figure 1:
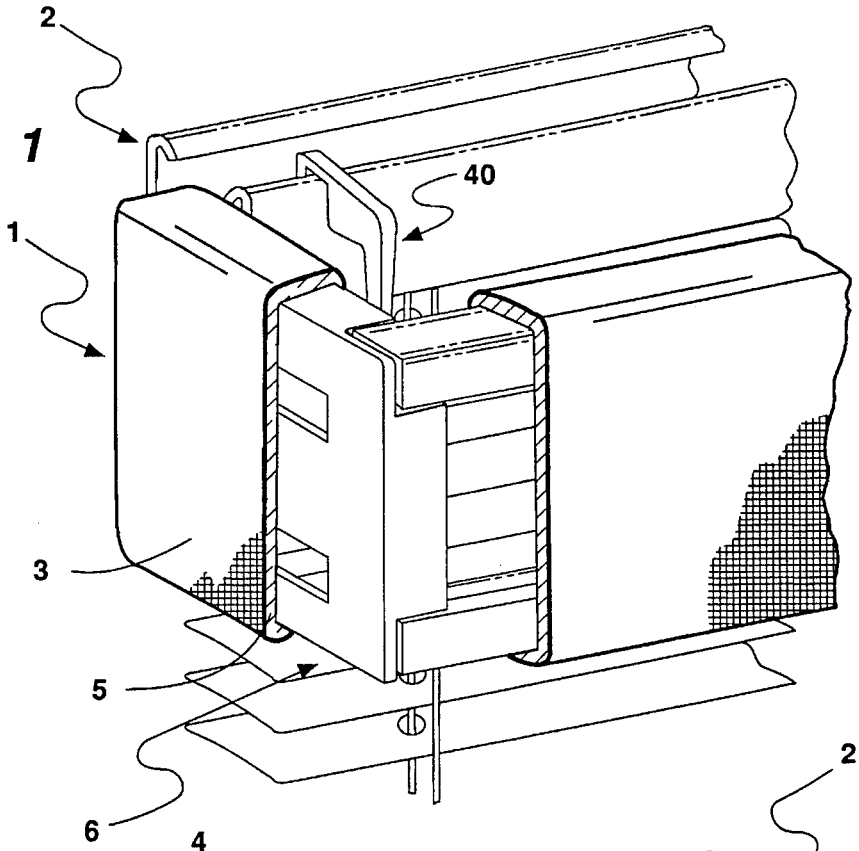
FIG. 1 is a perspective, fragmentary view of the assembled, fabric covered decorating assembly of this invention mounted to the headrail of a window covering unit with the fabric being partially cut away to show the underlying structure.

Referring to FIG. 1, decorating assembly I is shown in relation to a typical window covering unit 2. In this particular embodiment, decorating assembly 1 is mounted to headrail 4 of window covering unit 2 by mounting bracket 40. In most instances, structural assembly 6 will be covered by fabric 3. Optionally, foam material 5 may be used to provide a cushioned appearance. In most cases, fabric 3 and optional foam material 5 are affixed to side panels 20 and linear members 50 using a staples or hot melt adhesive.

Figure 2:
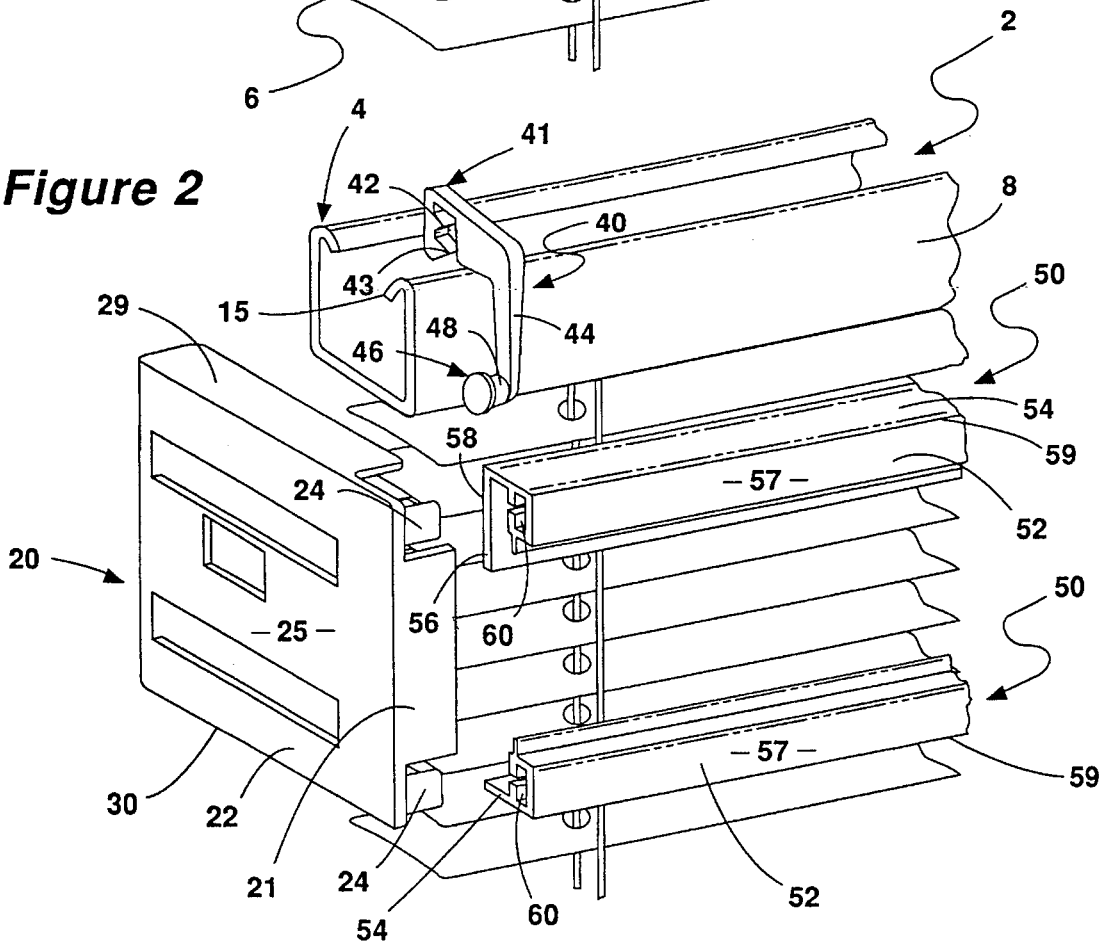
FIG. 2 is a perspective view similar to FIG. 1 showing the major structural elements of the structural assembly in exploded relation to the window covering unit.

As can best be seen in FIG. 2, the embodiment of decorating assembly 1 shown in FIG. 1 generally includes a structural assembly 6 having at least two linear members 50 and at least one side panel 20. Linear members 50 are generally injection molded or extruded from a plastic material such as polyvinylchloride (PVC), polypropylene, or ABS. Side panel 20 is generally injection molded from the same group of materials as linear members 50. Typically, side panel 20 will include at least two mounting post 24 extending rearwardly from front wall 22. In most cases, at least one of linear members 50 will have a cross section including front wall 52 establishing front surface 57, rear wall 56 establishing rear surface 58, and at least one transverse wall 54 establishing channel 61 between front wall 52 and rear wall 56. Flanges 55 extend from front wall 52 and from transverse wall 54 establishing slots 60. Optionally, flanges 55 can be configured to extend from rear wall 56 to provide the required functionality. Slots 60 are configured to accept mounting posts 24 such that linear members 50 can be attached to side panels 20 with front surface 57 flush with front edge 21 and with traverse wall 54 flush with adjacent top edge 29 or bottom edge 30.

Figure 3A:
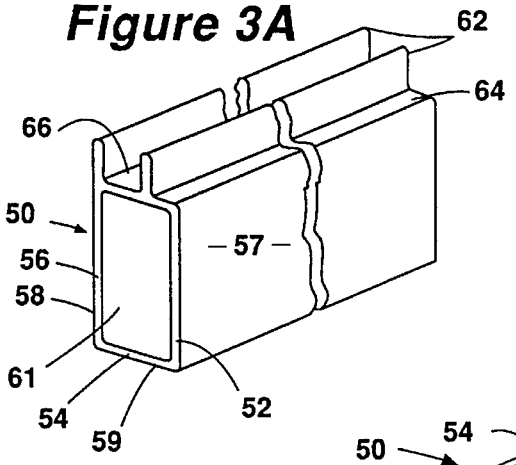
FIG. 3 is a perspective, fragmentary view showing a closed cross section-type linear member configuration.
Figure 3B:
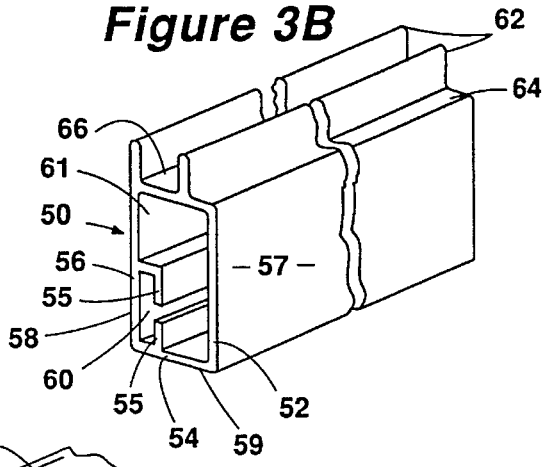
Figure 4B:
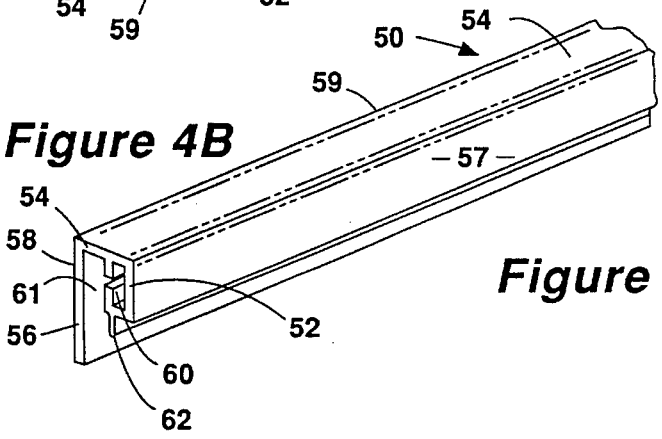
FIG. 4 is a perspective, fragmentary view showing an open cross section-type linear member configuration.
Figure 4A:
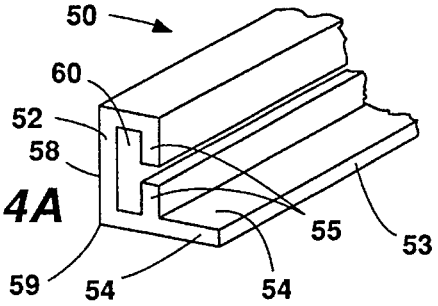
Figure 5A:
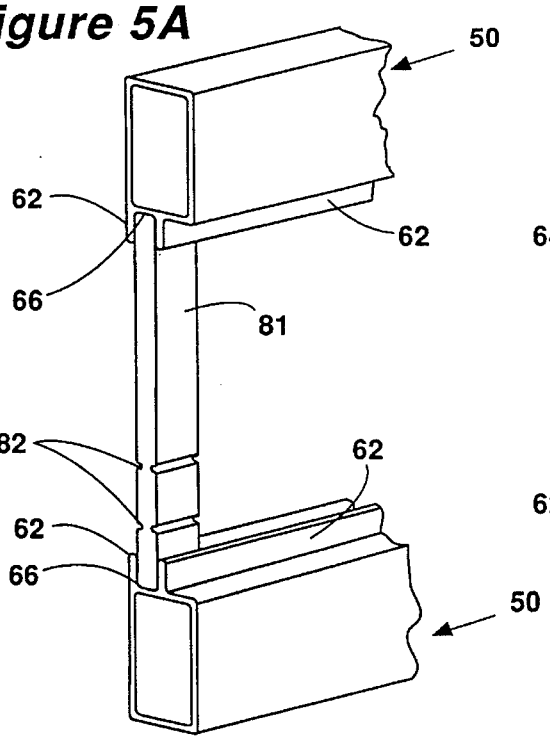
FIGS. 5A and 5B are perspective, fragmentary views showing linear members with a support member and an insert panel, respectively.
Figure 5B:
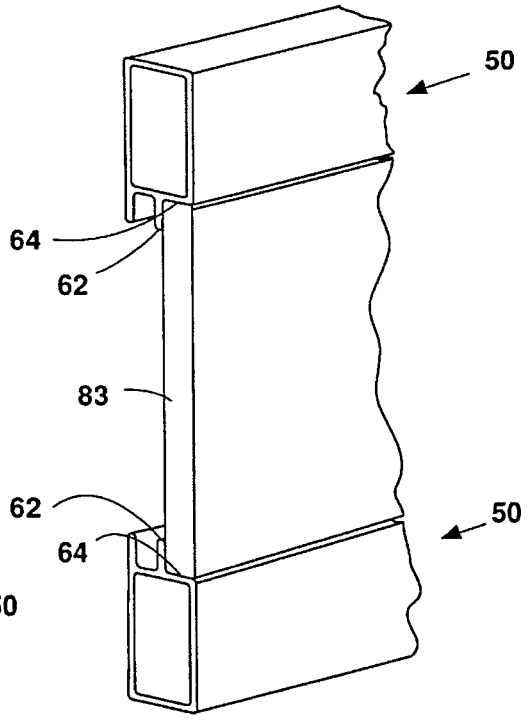

FIG. 3 shows linear member 50' having a closed cross section configuration and FIG. 4 shows linear member 50 having an open cross section configuration. When used in common assembly, the distance between the front surface 57 and rear surface 58 of linear member 50 in FIG. 3A is generally the same as the distance between front surface 57 and longitudinal edge 53 of linear member 20 in FIG. 3B. In cases where linear members 50 are extruded, the open cross section configuration will generally provide superior results. Linear member 50 and 50' may further include longitudinal projections 62 which establish recess 64 and in the case of linear member 50' support member slot 66. As shown in FIG. 5A, support member 81 is located within support member slot 66 to provide support between linear members 50. Support member 81 is generally injection molded or extruded from a plastic material. The longitudinal length of support member 81 is generally three to four times the width of support member slot 66. And to accommodate a variety of assembly sizes, support member 81 includes a plurality of notches 82 enabling it to be sized to the appropriate height by breaking at the correct notch 82. For applications where it is essential to have a structural assembly 6 with a front surface without an opening, insert panel 83 can be located in recessed portion 64, as shown in FIG. 5B. Insert panel 83 can be injection molded from a rigid plastic material or constructed from a readily available material such as foam core-type poster board.

As shown in FIGS. 7 and 8, mounting of decorating assembly 1 is facilitated by receptacle 26 having slot 28 located on the rear side of side panel 20. As best seen in FIG. 8, shaft 48 of mounting bracket 40 engages in slot 28 with shoulder 46 securely locating shaft 48 within slot 28. In the embodiment shown, clip portion 41 of mounting bracket 40, being located at the opposite end of extension arm 44 from shaft 48, is configured to attach to headrail 4 of window covering unit 2 in FIGS. 1 and 2. Ridge 42 of clip portion 41 engages under lip 15 of front wall 8 of headrail 4 and ridge 43 firmly engages against the rear surface of front wall 8. Furthermore, receptacle 26 can be replaced by a multitude of structural configurations enabling decorating assembly 1 to be mounted to a wall or to the headrail of a window covering unit. And still furthermore, clip portion 41 could be configured to accept a variety of headrail configurations not shown.

FIGS. 9A thru 9D show a variety of alternate configurations for mounting bracket 40 as configured for use with receptacle 26 shown in FIGS. 7 and 8. Specifically, 9A and 9C show mounting bracket 40 with flange 95 instead of clip portion 41. Flange 95 with holes 96 for fasteners such as screws is employed in cases where it is desirable to mount decorating assembly 1 to a wall rather than to headrail 4 of window covering unit 2. FIGS. 9C and 9D show mounting bracket 40 with extension arm 44 having a downward bend for applications where it is desired to have decorating assembly 1 downwardly offset from window covering unit 2. Similarly, extension arm 44 could have an upward bend enabling decorating assembly 1 to be upwardly offset.

FIG. 10 shows side panel 20' of FIGS. 1 and 2 with cavities 88 rather than mounting posts 24 and configured with a third cavity 88 to provide for a linear member 50 in the upper rear position of side panel 20 to provide a top surface on decorating assembly 1. Cavity 88 located at the top rear corner of side panel 20' enables a linear member 50 to be installed with front surface 57 flush with top edge 29 such that decorating assembly 1 can be constructed with a top surface. Decorative assembly 1 having linear member 50 at the upper rear position of side panel 20' can be mounted as previously discussed, or it can be mounted using mounting bracket 40 of FIG. 9E or 9F. Mounting bracket 40 in FIG. 9E is configured to be used with structural assembly 6 having a linear member 50 in the upper rear position. Mounting bracket 40 can be configured to attach to a wall via flange 95 or to headrail 4 of window covering unit 2 via clip portion 41. The upper rear linear member 50 rests on top of extension arm 44. As shown in FIG. 12, retaining arm 97 engages behind upper rear linear member to hold decorating 1 in place. Similarly, mounting bracket 40 of FIG. 9F can be used to mount decorating assembly 1 to headrail 4 of window covering unit 2.

This configuration is best achieved by extrusion while the configurations of side panel 20 in FIGS. 7 and 10A is best achieved by injection molding. The major difference between these configurations is that side panel 20 of FIG. 10B has the ability to provide a more extensive rear wall 56.

Union 89 of FIG. 11A is used with linear members 50 having flanges 55 that establish slot 60. Union 89' of FIG. 11B is used with linear members 50 not having flanges 55. In either case, horizontal and vertical wings 91 and 92 of side panel engaging portion 90 securely fit within cavities 88. In the case of linear members 50 having slot 60, mounting post 24 of linear member engaging portion 93 fits into slot 60. In the case of closed cross section type linear members 50' not having slot 60, horizontal and vertical wings 91 and 92 of linear member engaging portion 93 fits within channel 61.

FIGS. 13A, 13B, 13C, and 14 show a mechanical fastening system for retaining fabric 3. The major parts of this system include fabric fastening flange 68, grooves 70, and retaining strip 72. Fabric fastening flange 68 is preferably in combination with rear wall 56 of linear member 50 or 50 with at least one groove 70 running longitudinally along the length of fabric fastening flange 68. Fabric 3 is fastened by positioning it over groove 70 and engaging legs 73 of retaining strip 72 into groove 70 such that fabric 3 is bound in groove 70. Retaining strip 72 is preferably constructed of a resilient plastic material such that legs 73 are forcibly retained within groove 70. Similarly, fabric 3 is fastened to side panels 20 using similar structural elements As shown in FIG. 14, rear walls 23 include grooves 70. Optionally, fabric fastening flange 68 could be omitted and grooves 70 could be integral with rear wall 56 of linear members 50 or 50.

FIGS. 15A through 15D show a variety of decorating assemblies 1 having a contoured geometry along frontal edge 101 . FIG. 15A shows a single step square corner geometry. This geometry is provided using a right angle coupling 98 of FIG. 16A. Similarly, this geometry is also provided by right angle union 100 and linear coupling 102 of FIGS. 16 B and 16C., respectively. Right angle coupling 98 includes nipples 99 for attachment directly to linear members 50 or 50. The cross section of nipples 99 is determined by the specific geometry of slot 60 or channel 61. In the case where right angle union 100 is used, linear coupling 102 joins right angle union 100 to linear members 50 or 50. The single step square corner geometry is also provided by single step union 108 shown in FIG. 16E. Similarly, the single step rounded corner geometry of decorating assembly 1 shown in FIG. 15B is provided by S-curve union 110 in FIG. 16F, and the double step square corner geometry of decorating assembly 1 shown in FIG. 15C is provided by double step member 106 in FIG. 16D. The arched geometry of decorating assembly 1 of FIG. 15D is provided by contoured structural member 112 in FIG. 16G. Similarly, a multitude of geometric contours could be provided by one piece members similar to contoured structural member 112 shown in FIG. 16G.

Although the description above contains many specifics, these should not be construed as limiting the scope of the invention, but as merely providing illustrations of some of the preferred and potential embodiments of the invention at the time this application was drafted. Thus, the scope of the invention should be determined by the appended claims and their legal equivalents along with the examples and descriptions given, rather than by the examples and descriptions alone.

I claim:

1. An upholstered structural assembly for decorating the top of a window, the structural assembly comprising:

upper and lower front linear members having generally flat front and rear surfaces and a channel extending longitudinally between each of said linear members front and rear surfaces, said linear members having no elements projecting forward of said linear member front surface, two rectangular shape side panels having planar front and rear surfaces spaced apart approximately the same distance as said linear member front and rear surfaces and having means enabling said linear members to be joined to said side panels associated with each of at least two adjacent corners, the rectangular shape of said side panels defining the width and height of said side panels and the distance between said side panel front and rear surfaces establishing an edge extending around the perimeter of said side panels, said side panels having no elements projecting forward of said side panel front surface, and connecting means having a first portion being removably received by a respective one of said enabling means of said side panels and extending perpendicular to said side panel rear surface and a second portion for being received within the channels of a respective one of said linear members, said-first and second portions each having respective longitudinal axis which are parallel, said enabling means and said connecting means being configured to position each of said linear members front surface flush with the adjacent edge of said side panels whereby the width of said side panels define the overall depth of the structural assembly.

2. The structural assembly of claim 1, further including an upper rear linear member having substantially the same configuration as said upper front linear member.

3. The structural assembly of claim 1, further including means for releasably attaching a fabric covering to said linear members and said side panels.

4. The structural assembly of claim 1, wherein said enabling means is comprised of a cavity and wherein said connecting means is comprised of a discrete union.

5. The structural assembly of claim 4, further including an upper rear linear member having substantially the same configuration as said upper front linear member.

6. An upholstered structural assembly for decorating the top of a window, the structural assembly comprising:

upper and lower front linear members having generally flat front and rear surfaces and a channel extending longitudinally between each of said linear members front and rear surfaces, said linear members having no elements projecting forward of said linear member front surface, upper rear linear member of substantially the same configuration as said upper front linear member, two rectangular shape side panels having planar front and rear surfaces spaced apart approximately the same distance as said linear member front and rear surfaces and having means enabling said linear members to be joined to said side panels associated with each of at least three corners, the rectangular shape of said side panel defining the width and height of said side panels and the distance between said side panel front and rear surfaces establishing an edge extending around the perimeter of said side panels, said side panels having no elements projecting forward of said side panel front surface, and connecting means having a first portion being removably received by a respective one of said enabling means of said side panels and extending perpendicular to said side panel rear surface and a second portion for being received within the channels of a respective one of said linear members, said first and second portions each having respective longitudinal axis which are parallel, said enabling means and said connecting means being configured to position each of said linear members front surface flush with the adjacent edge of said side panels whereby the width of said side panels define the overall depth of the structural assembly.

7. The structural assembly of claim 6, further including means for releasably attaching a fabric covering to said linear members and said side panels.

8. An upholstered structural assembly for decorating the top of a window, the structural assembly comprising:

a lower front linear member having generally flat front and rear surfaces and a channel extending longitudinally between each of said linear members front and rear surfaces, said linear member having no elements projecting forward of said linear member front surface, contoured upper front traverse separation means of substantially the same cross sectional configuration as said lower front linear member two rectangular shape side panels having planar front and rear surfaces spaced apart approximately the same distance as said linear member front and rear surfaces and having means enabling said linear member and said traverse separation means to be joined to said side panels associated with each of at least two adjacent corners, the rectangular shape of said side panel defining the width and height of said side panels and the distance between said side panel front and rear surfaces establishing an edge extending around the perimeter of said side panels, said side panels having no elements projecting forward of said side panel front surface, and connecting means having a first portion being removably received by a respective one of said enabling means of said side panels and extending perpendicular to said side panel rear surface and a second portion for being received within the channel of a respective one of said linear member and said contoured traverse separation means, said first and second portions each having respective longitudinal axis which are parallel, said enabling means and said connecting means being configured to position each of said linear members front surface flush with the adjacent edge of said side panels whereby the width of said side panels define the overall depth of the structural assembly.

9. The structural assembly of claim 8, wherein said traverse separation means consists a contoured traverse member.

10. The structural assembly of claim 8, wherein said contoured traverse separation means is comprised of a plurality of linear members in combination with non-linear union means for providing the contour of traverse separation means.

11. The structural assembly of claim 8, further including upper rear traverse separation means having substantially the same configuration as said upper front traverse separation means.

12. The structural assembly of claim 8, further including means for releasably attaching a fabric covering to said linear members and said side panels.

13. The structural assembly of claim 8, wherein said enabling means is comprised of a cavity and wherein said connecting means is comprised of a discrete union.

14. The structural assembly of claim 13, further including upper rear traverse separation means having substantially the same configuration as said upper front traverse separation means.

15. An upholstered structural assembly for decorating the top of a window, the structural assembly comprising:

an upper front linear member having generally flat front and rear surfaces and a channel extending longitudinally between each of said linear members front and rear surfaces, said linear member having no elements projecting forward of said linear member front surface, contoured lower front traverse separation means of substantially the same cross sectional configuration as said upper front linear member, two rectangular shape side panels having planar front and rear surfaces spaced apart approximately the same distance as said linear member front and rear surfaces and having means enabling said linear member and said traverse separation means to be joined to said side panels associated with each of at least two adjacent corners, the rectangular shape of said side panels defining the width and height of said side panels and the distance between said side panel front and rear surfaces establishing an edge extending around the perimeter of said side panels, said side panels having no elements projecting forward of said side panel front surface, and connecting means having a first portion being removably received by a respective one of said enabling means of said side panels and extending perpendicular to said side panel rear surface and a second portion for being received within a respective one of the channel of said linear member and said contoured traverse separation means, said first and second portions each having respective longitudinal axis which are parallel, said enabling means and said connecting means being configured to position each of said linear members front surface flush with the adjacent edge of said side panels whereby the width of said side panels define the overall depth of the structural assembly.

16. The structural assembly of claim 15, wherein said traverse separation means consists a contoured traverse member.

17. The structural assembly of claim 15, wherein said contoured traverse separation means is comprised of a plurality of linear members in combination with non-linear union means for providing the contour of traverse separation means.

18. The structural assembly of claim 15, further including an upper rear linear member having substantially the same configuration as said upper front linear member.

19. The structural assembly of claim 15, further including means for releasably attaching a fabric covering to said linear members and said side panels.

20. The structural assembly of claim 15, wherein said enabling means is comprised of a cavity and wherein said connecting means is comprised of a discrete union.

21. The structural assembly of claim 20, further including an upper rear linear member having substantially the same configuration as said upper front linear member.

22. A window top decorating system for fabricating an upholstered structural assembly, the system comprising:

linear members having generally flat front and rear surfaces and a channel extending longitudinally between each of said linear members front and rear surfaces, said linear members having no elements projecting forward of said linear member front surface, rectangular shape side panels having planar front and rear surfaces spaced apart approximately the same distance as said linear member front and rear surfaces and having means enabling said linear members to be joined to said side panels associated with each of at least two adjacent corners, the rectangular shape of said side panels defining the width and height of said side panels and the distance between said side panel front and rear surfaces establishing an edge extending around the perimeter of said side panels, said side panels having no elements projecting forward of said side panel front surface, connecting means having a first portion being removably received by a respective one of said enabling means of said side panels and extending perpendicular to said side panel rear surface and a second portion for being received within the channels of a respective one of said linear members, said first and second portions each having respective longitudinal axis which are parallel, and brackets for mounting the upholstered structural assembly to a wall, said enabling means and said connecting means being configured to position each of said linear members front surface flush with the adjacent edge of said side panels whereby the width of said side panels define the overall depth of the structural assembly.

23. A kit for constructing an upholstered structural assembly for decorating the top of a window, the kit comprising:

upper and lower front linear members having generally flat front and rear surfaces and a channel extending longitudinally between each of said linear members front and rear surfaces, said linear members having no elements projecting forward of said linear member front surface, two rectangular shape side panels having planar front and rear surfaces spaced apart approximately the same distance as said linear member front and rear surfaces and having means enabling said linear members to be joined to said side panels associated with each of at least two adjacent corners, the rectangular shape of said side panels defining the width and height of said side panels and the distance between said side panel front and rear surfaces establishing an edge extending around the perimeter of said side panels, said side panels having no elements projecting forward of said side panel front surface, connecting means having a first portion being removably received by a respective one of said enabling means of said side panels and extending perpendicular to said side panel rear surface and a second portion for being received within the channels of a respective one of said linear members, said first and second portions each having respective longitudinal axis which are parallel, and brackets for mounting the upholstered structural assembly to a wall, said enabling means and said connecting means being configured to position each of said linear members front surface flush with the adjacent edge of said side panels whereby the width of said side panels define the overall depth of the structural assembly.

24. The kit of claim 23, further including an upper rear linear member having substantially the same configuration as said upper front linear member.

* * * * *